US005944484A

United States Patent [19]

Yu

[11] Patent Number: 5,944,484

[45] **Date of Patent: *Aug. 31, 1999**

[54] CEILING FAN HOUSING HAVING INNER FRAME

[76] Inventor: Jack Yu, No. 109-1, Ave. 6, Lane 164 Tzong Sa Road, Da Du Hsiang, Taichung Hsien, Taiwan

[ * ] Notice: This patent is subject to a terminal disclaimer.

[21] Appl. No.: 08/919,751

[22] Filed: Aug. 28, 1997

[51] Int. Cl.[6] ..... F04D 29/52; F04D 29/64

[52] U.S. Cl. ..... 416/5; 362/96; 362/122; 362/240; 362/294

[58] Field of Search ..... 416/5, 93 R, 170 R, 416/244 R; D23/377, 379, 385, 411; 417/360, 423.14; 415/214.1; 362/92, 122, 240, 149, 294, 373; 310/89; 403/335, 336, 338; 411/84

[56] References Cited

U.S. PATENT DOCUMENTS

| | | | |
|---|---|---|---|
| 4,363,083 | 12/1982 | Tanaka et al. | 362/294 |
| 4,402,649 | 9/1983 | Laurel | 416/5 |
| 4,518,314 | 5/1985 | Schultz | 416/5 |
| 4,626,970 | 12/1986 | Huang | 416/5 |
| 4,863,346 | 9/1989 | Lin | 416/5 |
| 5,404,284 | 4/1995 | Davis, Jr. | 416/5 |
| 5,439,350 | 8/1995 | Yu . | |
| 5,441,387 | 8/1995 | Yu . | |
| 5,454,692 | 10/1995 | Davis | 416/5 |
| 5,503,544 | 4/1996 | Yu . | |
| 5,580,156 | 12/1996 | Suzuki et al. | 362/373 |
| 5,655,877 | 8/1997 | Yu | 416/5 |
| 5,672,048 | 9/1997 | Yu | 416/5 |
| 5,681,147 | 10/1997 | Yung-Chung | 416/5 |
| 5,797,721 | 8/1998 | Yu | 416/6 |

*Primary Examiner*—Christopher Verdier
*Attorney, Agent, or Firm*—Charles E. Baxley, Esq.

[57] ABSTRACT

A ceiling fan housing includes a cylindrical member of transparent material and a cover engaged on top of the cylindrical member. A frame is received in the cylindrical member and disposed between the bottom plate and the cover and includes one or more panels. A number of fasteners may secure the cylindrical member and the cover and the frame together. The frame includes a ring. The panels are extended radially outward from the ring for allowing the frame to be easily assembled to the cylindrical member and the cover by the fasteners.

1 Claim, 2 Drawing Sheets

CEILING FAN HOUSING HAVING INNER FRAME

BACKGROUND OF THE INVENTION

1. Field of the Invention

The present invention relates to a housing, and more particularly to a ceiling fan housing.

2. Description of the Prior Art

The closest prior art of which applicant is aware are U.S. Pat. Nos. 5,439,350, 5,441,387 and 5,503,524, all issued to Yu who is also the applicant of the present invention. The prior arts discloses a ceiling fan housing that includes a number of patterns or panels secured to a cylindrical member. However, the panels are exposed such that gaps are formed between the panels and the cylindrical member and such that the ceiling fan housing may not be easily cleaned.

The present invention has arisen to mitigate and/or obviate the afore-described disadvantage of conventional ceiling fan housings.

SUMMARY OF THE INVENTION

The primary objective of the present invention is to provide a ceiling fan housing which includes a number of panels secured in a cylindrical member of glass or transparent material for allowing the patterns of the panels to be seen through the transparent cylindrical member.

In accordance with one aspect of the invention, there is provided a housing for a ceiling fan comprising a cylindrical member made of transparent material, the cylindrical member including an upper portion and a bottom plate, a cover engaged on the upper portion of the cylindrical member, a frame received in the cylindrical member and disposed between the bottom plate and the cover and including at least one panel, and a plurality of fastening members engaged through the cover and the frame and the bottom plate for securing the bottom plate and the cylindrical member and the cover together, and for securing the frame in place.

The frame includes a ring, the panel is extended radially outward from the ring for allowing the frame to be easily engaged with the fastening members.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
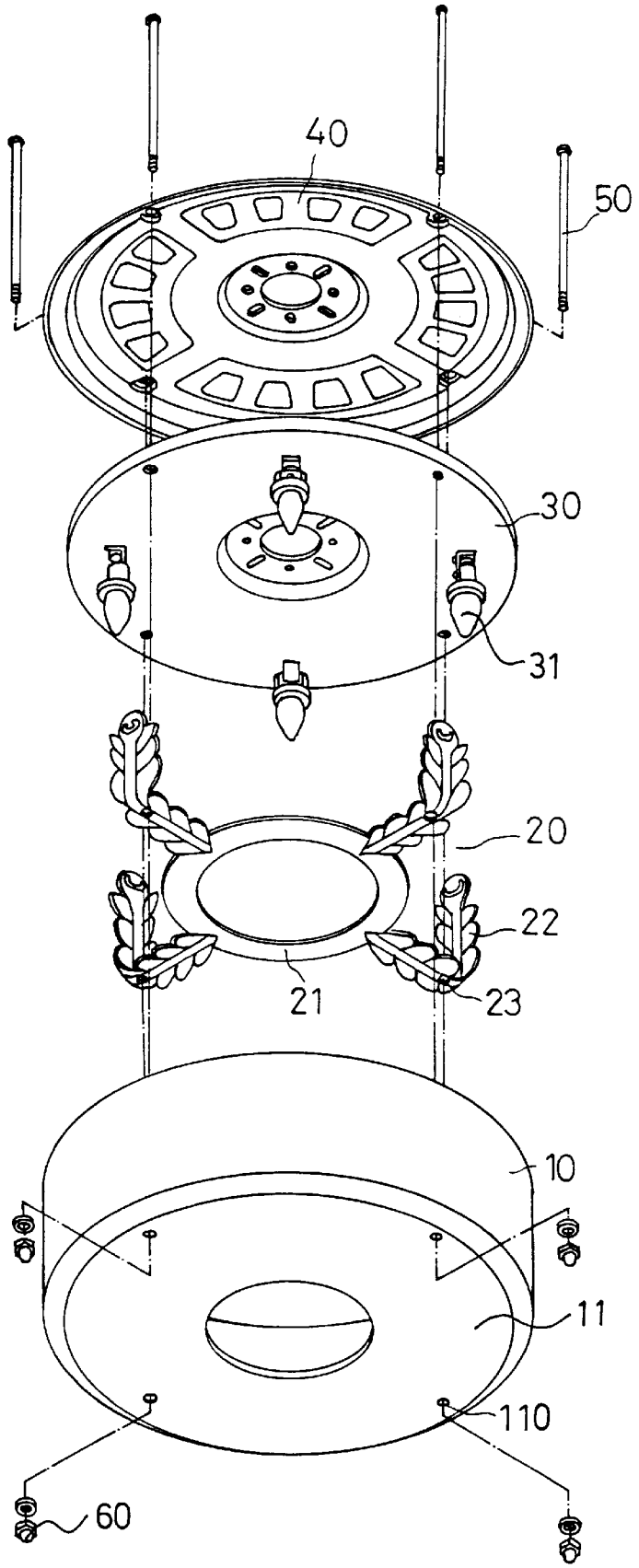
FIG. 1 is an exploded view of a ceiling fan housing in accordance with the present invention.
Figure 2:
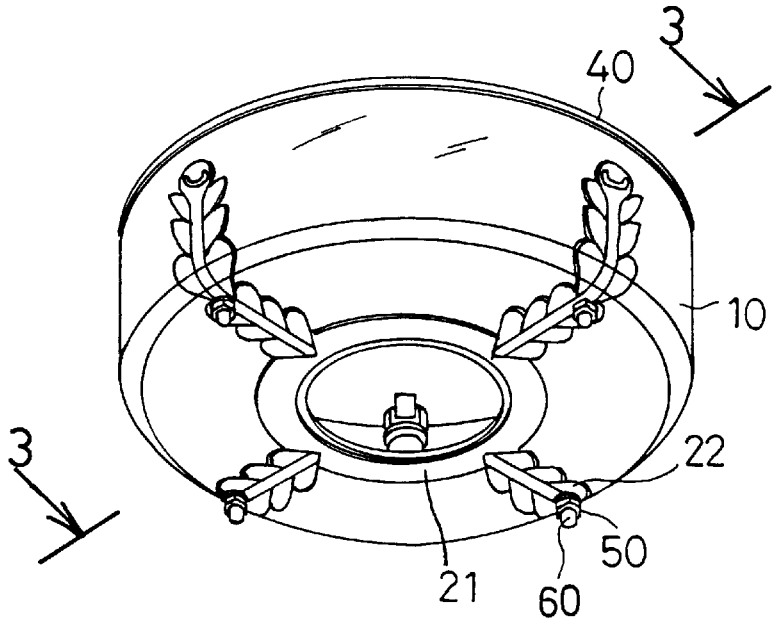
FIG. 2 is a bottom perspective view of the ceiling fan housing.
Figure 3:
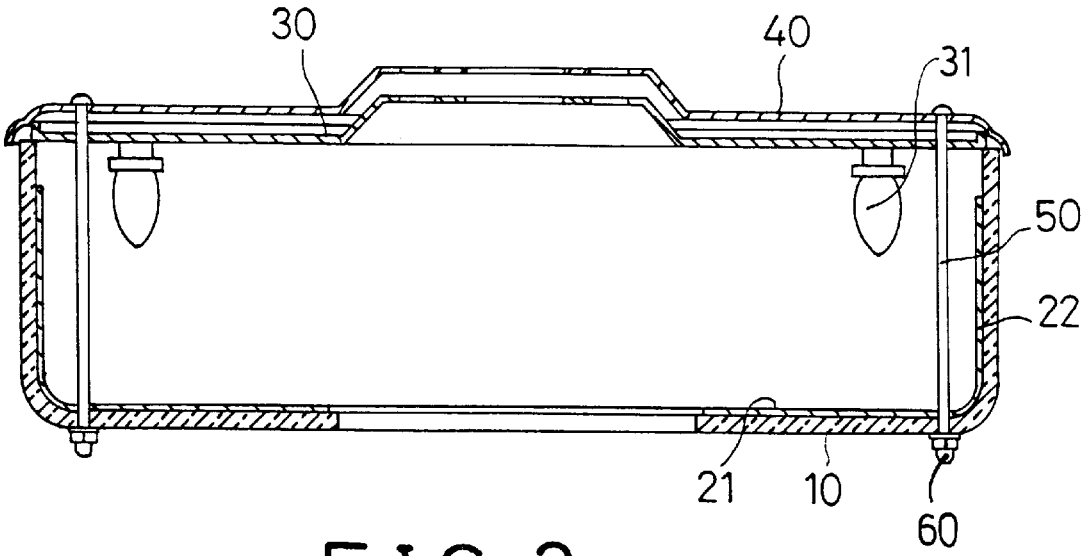
FIG. 3 is a cross sectional view of the ceiling fan housing, taken along lines 3—3 of FIG. 2.

A co-pending U.S. patent application was filed on Aug. 22, 1996, with the Ser. No. 08/701,679 now U.S. Pat. No. 5,672,048, entitled "CEILING FAN HOUSING". The co-pending U.S. patent application is taken as a reference of the present invention.

Referring to the drawings, a ceiling fan housing in accordance with the present invention comprises a cylindrical member 10 including a bottom plate 11 in the form of a peripheral flange extended radially inward from the bottom portion of the cylindrical member 10. The bottom plate 11 includes a number of holes 110 for engaging with bolts 50 which may engage with nuts 60. A board 30 and a cover 40 are engaged on the cylindrical member 10. The board 30 is provided for securing a number of light bulbs 31. A frame 20 is engaged in the cylindrical member 10 and includes a ring 21 and a number of panels 22 of suitable patterns. The panels 22 are extended radially outward from the ring 21 and formed integral with the ring 21 and each includes an orifice 23 for engaging with the bolts 50. The bolts 50 are engaged through the cover 40 and the board 30 and the bottom plate 11 of the cylindrical member 10 and are engaged with the nuts 60 so as to secure the cover 40 and the board 30 and the cylindrical member 10 together. The bolts 50 also engage through the panels 22 for securing the panels 22 in place.

It is to be noted that the cylindrical member 10 is made of transparent material, such as glass, for allowing the panels 22 to be seen through the transparent cylindrical member 10. Beautiful lights and shapes may be formed when the light bulbs 31 are energized. It is further to be noted that the bottom plate 11 is not necessary to be formed integral with the cylindrical member 10 and may be separated from the cylindrical member 10. The panels 22 are not necessary to be secured to the cylindrical member 10 such that the cylindrical member 10 will not be easily broken when the cylindrical member 10 is made of glass material. The panels 22 are secured together or formed integral with the ring 21 such that the panels 22 may be easily retained in place while assembling the panels 22 and such that the frame 20 may be easily assembled in place by the fasteners 50.

Accordingly, the ceiling fan housing includes a number of panels secured to a ring for allowing the ring and the panels to be easily assembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A housing, for a ceiling fan, and comprising in combination:

a unitary cylindrical member made of transparent material, the cylindrical member surrounding an inner space and the cylindrical member including an inner wall surface and the cylindrical member further including an integral upper portion and having a bottom plate rigidly connected to the cylindrical member;

a cover on the upper portion of the cylindrical member;

a board positioned in the cylindrical member in the vicinity of the cover, the board provided with at least one light emitter;

a frame in the cylindrical member and disposed between the bottom plate and the cover and in contact with the bottom plate, the frame including a ring and having a plurality of panels each connected rigidly to the ring and extending radially outwardly from the ring to the vicinity of the inner wall surface of the cylindrical member;

a plurality of straight bolts one for each of the panels, each of the bolts extending in seriatim through a hole defined in the cover and through a hole defined in the board and through a hole defined in one of the panels and through a hole defined in the bottom plate, a nut provided on each of the bolts for securing the housing with the frame firmly in place therein.

* * * * *